US010151319B2

(12) United States Patent
Liang et al.

(10) Patent No.: US 10,151,319 B2
(45) Date of Patent: Dec. 11, 2018

(54) WIRING BOX FIXING STRUCTURE FOR VENTILATING FAN

(71) Applicants: Panasonic Ecology Systems Guangdong Co., Ltd., Foshan, Guangdong (CN); Panasonic Corporation, Osaka (JP)

(72) Inventors: Qiuqian Liang, Guangdong (CN); Naoya Araki, Aichi (JP); Masato Suzuki, Aichi (JP)

(73) Assignees: Panasonic Ecology Systems Guangdong Co., Ltd., Foshan, Guangdong (CN); Panasonic Corporation, Osaka (JP)

( * ) Notice: Subject to any disclaimer, the term of this patent is extended or adjusted under 35 U.S.C. 154(b) by 307 days.

(21) Appl. No.: 14/923,876

(22) Filed: Oct. 27, 2015

(65) Prior Publication Data

US 2016/0123337 A1 May 5, 2016

(30) Foreign Application Priority Data

Oct. 31, 2014 (CN) ..... 2014 2 0644754 U

(51) Int. Cl.

| | |
|---|---|
| ***F04D 25/06*** | (2006.01) |
| ***F04D 25/08*** | (2006.01) |
| ***F04D 29/42*** | (2006.01) |
| ***F04D 29/62*** | (2006.01) |

(52) U.S. Cl.

CPC ..... *F04D 25/0693* (2013.01); *F04D 25/08* (2013.01); *F04D 29/4226* (2013.01); *F04D 29/626* (2013.01)

(58) Field of Classification Search

CPC ..... F01D 25/24; F04D 25/0693; F04D 25/08; F04D 29/441; F04D 29/4226; F04D 29/563; F04D 29/601; F04D 29/626; F05D 2240/14; H02K 5/22; H02K 5/225; H05K 7/20136

USPC ..... 310/71, 89; 361/679.48, 695; 415/206, 415/211.2; 417/423.1, 423.14

See application file for complete search history.

(56) References Cited

U.S. PATENT DOCUMENTS 4,336,749 A * 6/1982 Barnhart ..... F24F 13/20 248/58
6,069,317 A * 5/2000 Wagganer ..... H02G 3/088 174/650
6,300,564 B1 * 10/2001 Moraes ..... H05K 5/0247 174/535

(Continued)

*Primary Examiner* — Patrick Hamo
*Assistant Examiner* — Joseph S. Herrmann
(74) *Attorney, Agent, or Firm* — RatnerPrestia

(57) ABSTRACT

A ventilating fan, includes a housing having an opening at a bottom surface thereof, a casing disposed in the housing, fan blades and a motor disposed in the casing, and a wiring box fixed on the casing and composed of a box body and a cover. The wiring box is fixed on the casing through a fixing structure, the fixing structure includes a first fixing means and a second fixing means, and the first fixing means includes a screw fixing structure, and the second fixing means includes an engaging fixing structure. An advantage of the ventilating fan lies in that, while preventing a user from detaching the wiring box manually, the ventilating fan has reduced components and can simplify operating steps during fixing the wiring box on the casing, and is thereby less time consuming.

7 Claims, 15 Drawing Sheets

(56) References Cited

U.S. PATENT DOCUMENTS

| | | | | |
|---|---|---|---|---|
| 6,664,682 | B2 * | 12/2003 | Williams | H02K 5/225 310/43 |
| 6,933,638 | B2 * | 8/2005 | Hirth | H02K 5/225 310/62 |
| 7,923,875 | B2 * | 4/2011 | Henry | H02K 5/225 310/64 |
| 8,961,150 | B2 * | 2/2015 | Yang | F04D 29/4213 417/312 |
| 2016/0123337 | A1 * | 5/2016 | Liang | F04D 25/0693 415/214.1 |

* cited by examiner

1

1

1

WIRING BOX FIXING STRUCTURE FOR VENTILATING FAN

CROSS-REFERENCE TO RELATED APPLICATION

This application claims the benefit of the Chinese Patent Application No. 201420644754.6 filed on Oct. 31, 2014 in the State Intellectual Property Office of China, the whole disclosure of which is incorporated herein by reference.

BACKGROUND OF THE INVENTION

Field of the Invention

This disclosure relates to a ventilating fan, and specifically, to a fixing structure for a wiring box of a ventilating fan.

Description of the Related Art

FIG. 1A is an overall schematic view of an existing ventilating fan; FIG. 1B is a schematic view showing the installation between a casing and a wiring box in the existing ventilating fan.

The existing ventilating fan 1 comprises: a housing 2 having an opening 3 at a bottom surface thereof, a casing 4 disposed in the housing 2, fan blades 51 and a motor 5 disposed in the casing 4, and a wiring box 8 fixed on the casing 4 and composed of a box body 6 and a cover 7, the wiring box 8 being fixed on the casing 4 through a screw 9.

Since the wiring box 8 contains electric components therein, a structure for preventing a user from detaching the box 8 manually should be provided to ensure safety of customers. For example, in the existing ventilating fan 1, the wiring box 8 is usually fixed on the casing 4 through the screw 9. Moreover, to ensure stability of the wiring box 8, a plurality of fixing structures should be provided, that is, a plurality of screws 9 should be used to fix the wiring box.

However, the existing structure for fixing the wiring box 8 on the casing 4 has a problem of needing too much working hour due to many components and complicated operating steps.

SUMMARY OF THE INVENTION

An object of this disclosure is to provide a ventilating fan that has reduced components and can simplify operating steps during fixing the wiring box on the casing, and is thereby less time consuming.

To achieve such an object, the present disclosure provides a ventilating fan comprising: a housing having an opening at a bottom surface thereof, a casing disposed in the housing, fan blades and a motor disposed in the casing, and a wiring box fixed on the casing and composed of a box body and a cover, the wiring box being fixed on the casing through a fixing structure, wherein the fixing structure comprises a first fixing means and a second fixing means, and wherein the first fixing means comprises a threaded fixing structure, and the second fixing means comprises an engaging fixing structure.

An advantage of the ventilating fan in this disclosure lies in that, while preventing a user from detaching the wiring box manually, the ventilating fan has reduced components and can simplify operating steps during fixing the wiring box on the casing, and is thereby less time consuming.

DETAILED DESCRIPTION OF PREFERRED EMBODIMENTS OF THE INVENTION

Figure 1A:
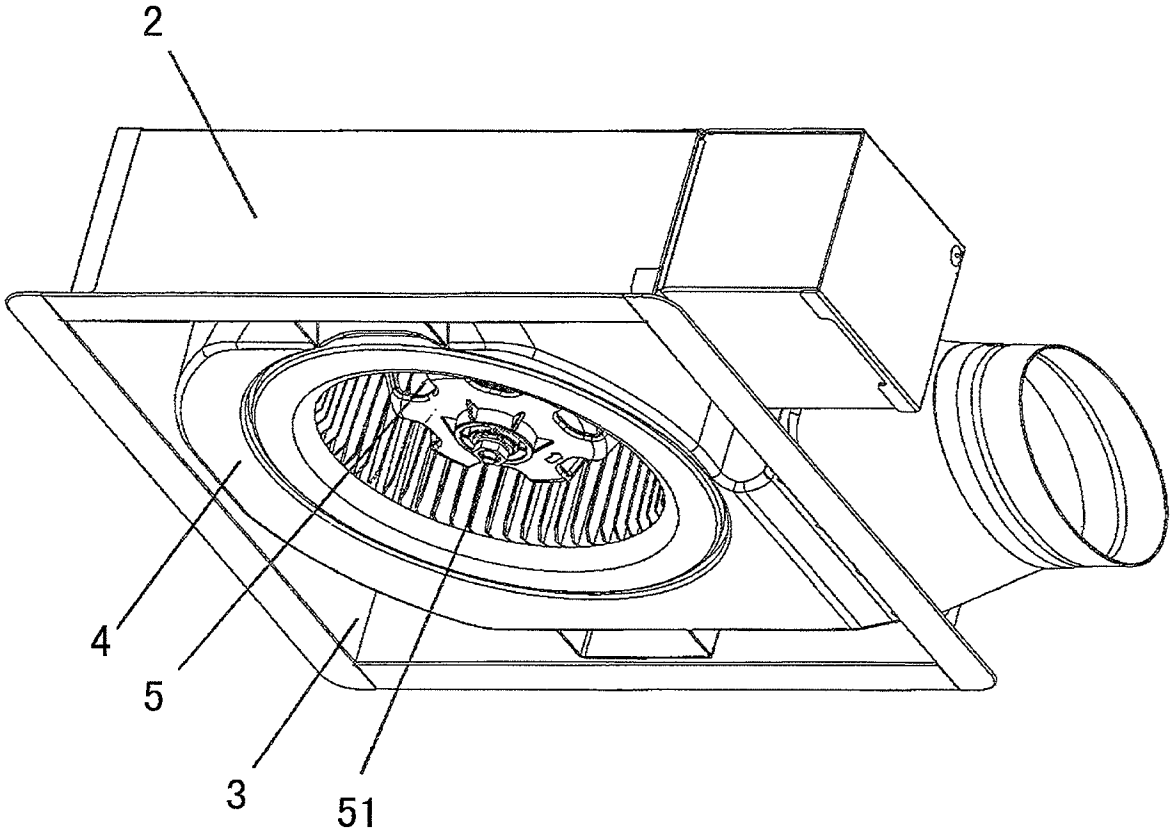
Fig. 1A Prior Art
FIG. 1A is an overall schematic view showing an existing ventilating fan.
Figure 1B:
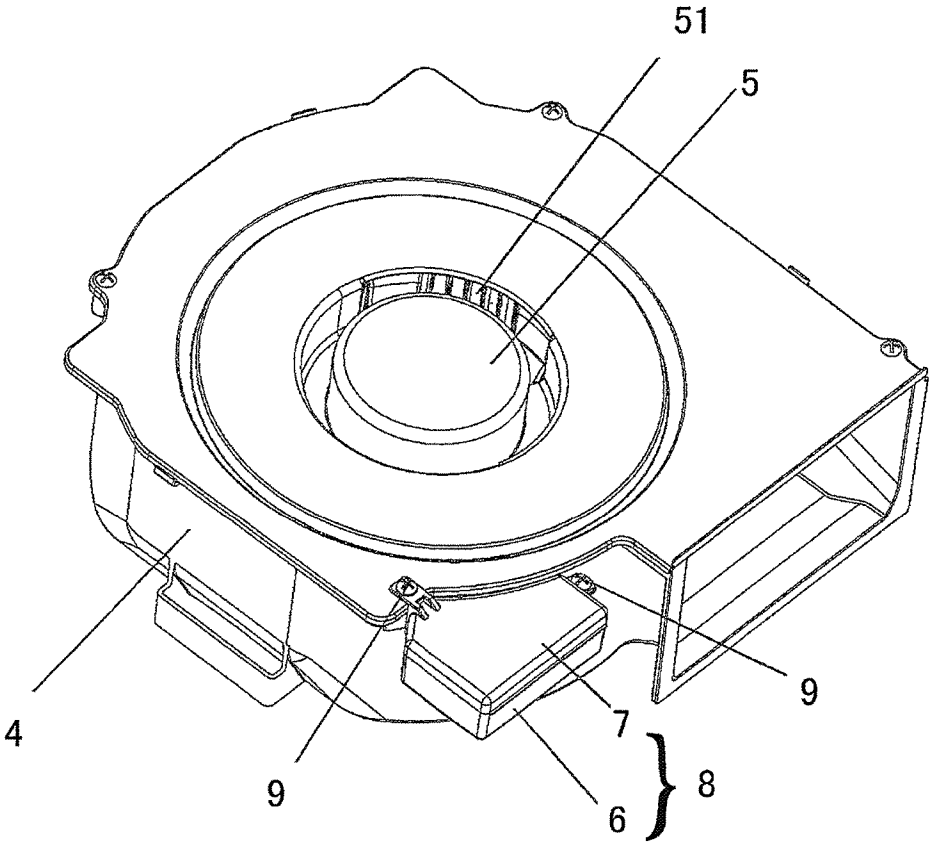
Fig. 1B Prior Art
FIG. 1B is a schematic view showing the installation between a casing and a wiring box in the existing ventilating fan.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

Figure 2:
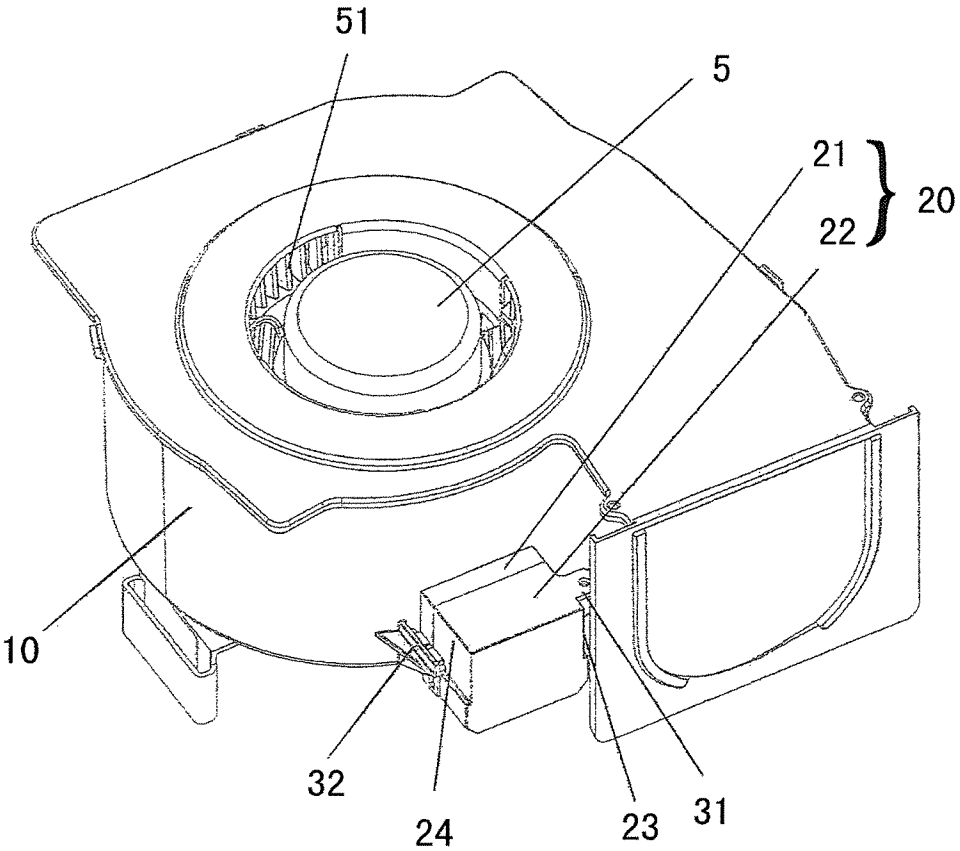
FIG. 2 is an overall schematic view showing a ventilating fan according to a first embodiment of the invention, in which the housing is removed.
Figure 3:
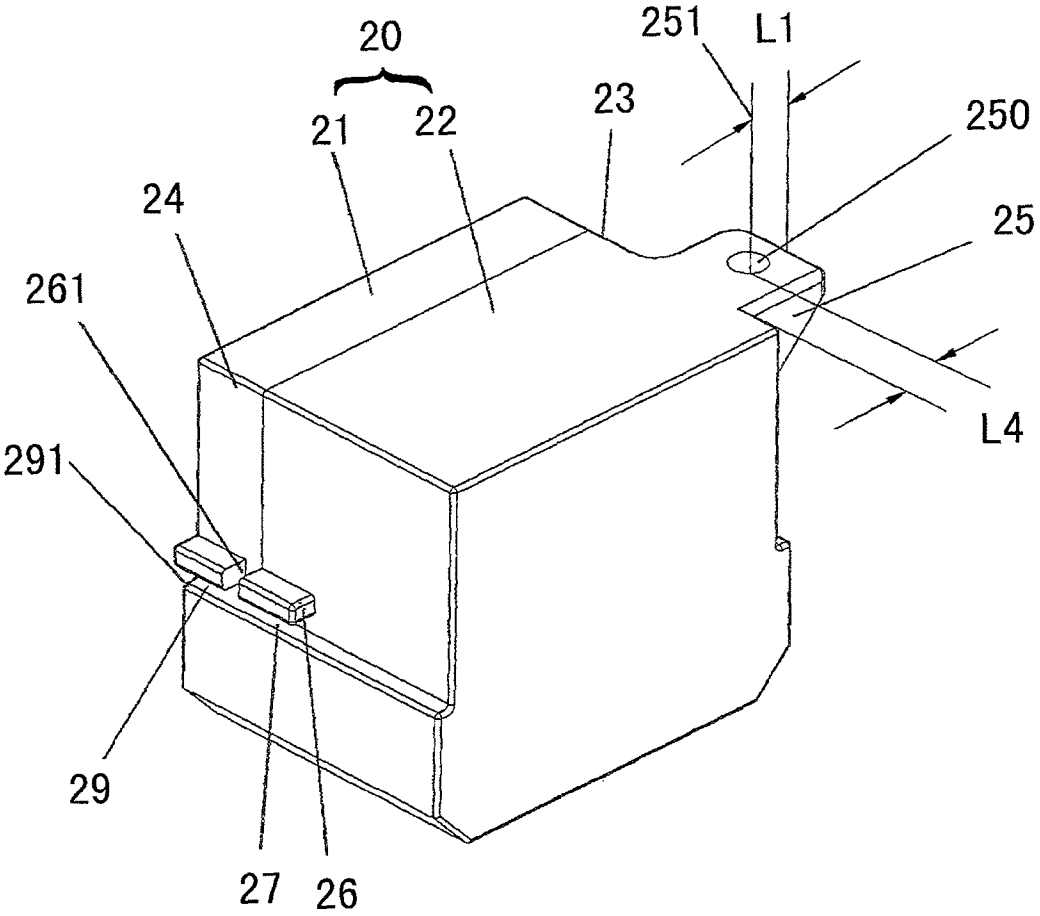
FIG. 3 is a schematic view showing a wiring box in the first embodiment of the invention.
Figure 4:
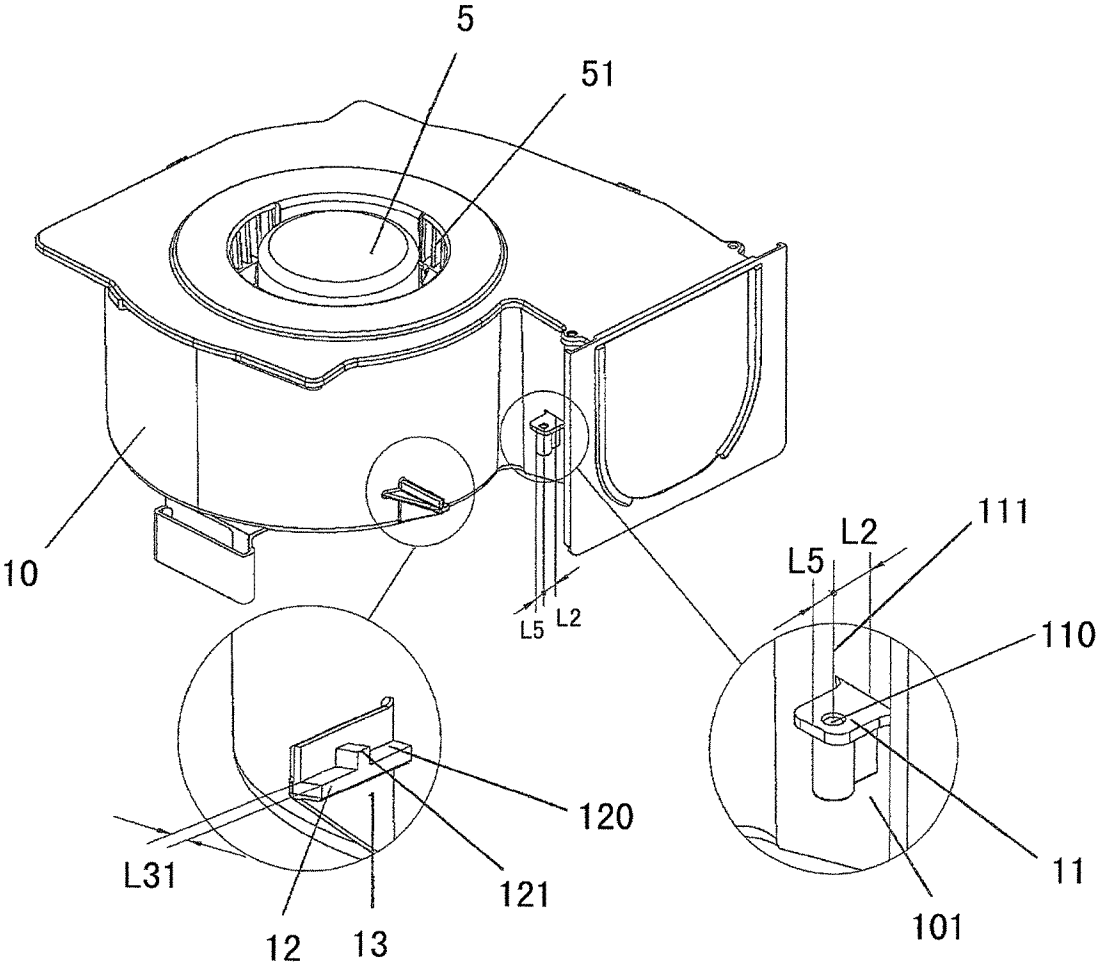
FIG. 4 is a schematic view showing a casing in the first embodiment of the invention.

FIG. 2 is an overall schematic view showing a ventilating fan according to a first embodiment of the invention, in which the housing is removed; FIG. 3 is a schematic view showing a wiring box in the first embodiment of the invention; FIG. 4 is a schematic view showing a casing in the first embodiment of the invention.

As shown in FIGS. 2, 3 and 4, the ventilating fan 1 according to the first embodiment of the invention comprises: a housing (not shown) having an opening at a bottom surface thereof, a casing 10 disposed in the housing (not shown), fan blades 51 and a motor 5 disposed in the casing 10, and a wiring box 20 fixed on the casing 10 and composed of a box body 21 and a cover 22. The wiring box 20 is fixed on the casing 10 through a fixing structure, and the fixing structure comprises a first fixing means 31 and a second fixing means 32, the first fixing means 31 comprises a threaded fixing structure, and the second fixing means 32 comprises an engaging fixing structure.

With the above configuration, when the wiring box 20 is fixed onto the casing 10, firstly, the second fixing means 32 is fixed through an engaging fixing structure, then the first fixing means 31 is fixed through a screw fixing structure, such that the wiring box 20 is fixed on the casing 10.

When the wiring box 20 is fixed on the casing 10, the number of components can be reduced, operating steps can be simplified, and labor time can be reduced.

Next, please refer to FIGS. 3 and 4, the screw fixing structure of the first fixing means 31 comprises: a first boss 25 disposed at a first end 23 of the wiring box 20 to protrude outward, and a second boss 11 provided on the casing 10 at a position thereof corresponding to the first boss 25 and protruded towards the wiring box 20. The first and the second bosses 25, 11 are provided with a hole 250 and 110 in a vertical direction thereof respectively.

The engaging fixing structure of the second fixing means 32 comprises a first recess 29 formed at a second end 24 of the wiring box 20, and a first rib 12 provided on the casing 10 at a position thereof corresponding to the first recess 29, the first rib 12 and the first recess 29 engage with each other.

The first recess 29 is formed by a gap between a second rib 26 and a third rib 27, both of which are formed at the second end 24 of the wiring box 20 and protruded outwards. The casing 10 is provided with a third boss 13 protruded outwards, the first rib 12 is disposed on a side of the third boss 13 of the casing 10 for engaging with the above first recess 29, and the first rib 12 is movable within the first recess 29.

With the above configuration, when the wiring box 20 is fixed onto the casing 10, the second fixing means 32 is firstly fixed, and then the first fixing means 31 is fixed. Specifically, firstly, the gap formed between the second rib 26 and the third rib 27 that are formed at the second end 24 of the wiring box 20 and protruded outwards, i.e., the first recess 29, is aligned with and contacts the first rib 12 formed on the third boss 13 of the casing 10 and protruded outwards. Then, push the wiring box 20 towards the fan blades 51 and the motor 5 of the casing 10, and the first recess 29 in the wiring box 20 contacts the first rib 12 and moves, under the guidance of the first rib 12, in a direction toward the fan blades 51 and the motor 5 of the casing 10, under the external force pushed on the wiring box 20, until the wiring box 20 is moved to a position where an edge 291 of the first recess 29 contacts the casing 10. At this time, the hole 250 in the first boss 25 provided at the first end 23 of the wiring box 20 is overlapped with the hole 110 in the second boss 11 extending from the casing 10. Finally, a screw is passed through the hole 250 in the first boss 25 and the hole 110 in the second bosses 11 from top to bottom, such that the wiring box 20 is fixed on the casing 10.

Moreover, the first recess 29 contacts the first rib 12, so that even if an external pushing force is applied, the force is distributed to the third boss 13, thus the external force applied on the first rib 12 is reduced, and the first rib 12 can be protected from being damaged. While the first rib 12 is protected from being damaged when the wiring box 20 is fixed on the casing 10, the number of components can be reduced, operating steps can be simplified, and labor time can be saved.

With the first recess 29 provided at the second end 24 of the wiring box 20 contacting and engaging with the first rib 12 on the casing 10, the first rib 12 is engaged into the first recess 29, so that a movement of the second end 24 of the wiring box 20 in the up-and-down direction is restricted. Moreover, after the wiring box 20 is pushed to a position where the edge 291 of the recess 29 contacts the casing 10, a screw is passed through the hole 250 in the first boss 25 and the hole 110 in the second boss 11 from top to bottom, such that the wiring box 20 is fixed on the casing 10. As a result, a movement of the second end 24 of the wiring box 20 towards the fan blades 51 and the motor 5 is also restricted. While the movements of the first end 23 of the wiring box 20 secured by the screw are restricted in the up-and-down, fore-and-aft, and left-and-right directions, a movement of the second end 24 of the wiring box 20 in the left-and-right direction is restricted too.

With the above configuration, only one screw is needed to securely fix the wiring box 20 on the casing 10, and at the same time, the wiring box 20 is protected from being detached by a user manually.

The first rib 12 is provided with a first protuberance 121 on a horizontal top surface 120 thereof in the vertical direction, and the second rib 26 is provided with a first cutout 261 engaging with the first protuberance 121 of the first rib 12. The positional relationship between the wiring box 20 and the casing 10 meets the following conditions:

$$L1<L2,$$

and $$L2-L1=L31,$$

wherein, L1 is a distance from a central line 251 of the hole 250 in the first boss 25 of the wiring box 20 to an outmost edge of the first boss 25 of the wiring box 20, L2 is a distance from a central line 111 of the hole 110 in the second boss 11 of the casing 10 to a side wall 101 of the casing 10, and L31 is a width of the first rib 12 of the third boss 13 of the casing 10 extending inwards, that is, extending towards the second boss 11.

The positional relationship also meets the following conditions:

$$L4>L5,$$

and $$L4-L5=L31,$$

wherein, L4 is a distance from the central line 251 of the hole 250 in the first boss 25 of the wiring box 20 to the side wall of first end 23 of the wiring box 20, L5 is a distance from the central line 111 of the hole 110 in the second boss 11 of the casing 10 to the outmost edge of the first boss 11 of the casing 10.

When the wiring box 20 is fixed onto the casing 10, the second fixing means 32 is firstly fixed, and then the first fixing means 31 is fixed. Specifically, firstly, the gap formed between the second rib 26 and the third rib 27 that are formed at the second end 24 of the wiring box 20 and protruded outwards, i.e., the first recess 29, is aligned with and contacts the first rib 12 formed on the third boss 13 of the casing 10. Then, push the wiring box 20 towards the fan blades 51 and the motor 5 of the casing 10. In such a manner, the first recess 29 in the wiring box 20 contacts the first rib 12 and guided the first rib 12 to move in a direction toward the fan blades 51 and the motor 5 of the casing 10, under the external force pushed on the wiring box 20.

Because the first rib 12 is provided with the first protuberance 121 on the horizontal top surface 120 thereof in the vertical direction, the first protuberance 121 may contact the second rib 26 so that the wiring box 20 cannot move towards the casing 10. In this situation, because the relationship, L1<L2, L2-L1=L31, L4>L5, and L4−L5=L31 is satisfied, a user only needs to move the wiring box 20 towards the second boss 11 of the casing 10, then move the wiring box 20 in a direction toward the fan blades 51 and the motor 5 of the casing 10, and when the wiring box 20 is moved such that the first protuberance 121 is aligned with the first cutout 261, move the wiring box 20 towards the third boss 13 of the casing 10 such that the first protuberance 121 projecting from the horizontal top surface 120 of the first rib 12 in the vertical direction of the first rib 12 is engaged into the first cutout 261 provided in the second rib 26 of the wiring box 20. In such a manner, movements of the second end 24 of the wiring box 20 in the fore-and-aft and up-and-down directions are both restricted, and at this time, the hole 250 in the first boss 25 provided at the first end of the wiring box 20 is overlapped with hole 110 in the second boss 11 extending from the casing 10. Finally, a screw is passed through the hole 250 in the first boss 25 and the hole 110 in the second bosses 11 from top to bottom, such that the wiring box 20 is fixed on the casing 10.

In this way, the movements of the first end 23 of the wiring box 20 fixed by the screw in the up-and-down, fore-and-aft, and left-and-right directions are restricted, and at the same time, a movement of the second end 24 of the wiring box 20 in the left-and-right direction is restricted too.

With the above configuration, only one screw is needed to securely fix the wiring box 20 on the casing 10, and at the same time, the wiring box 20 is protected from being detached by a user manually.

Figure 5:
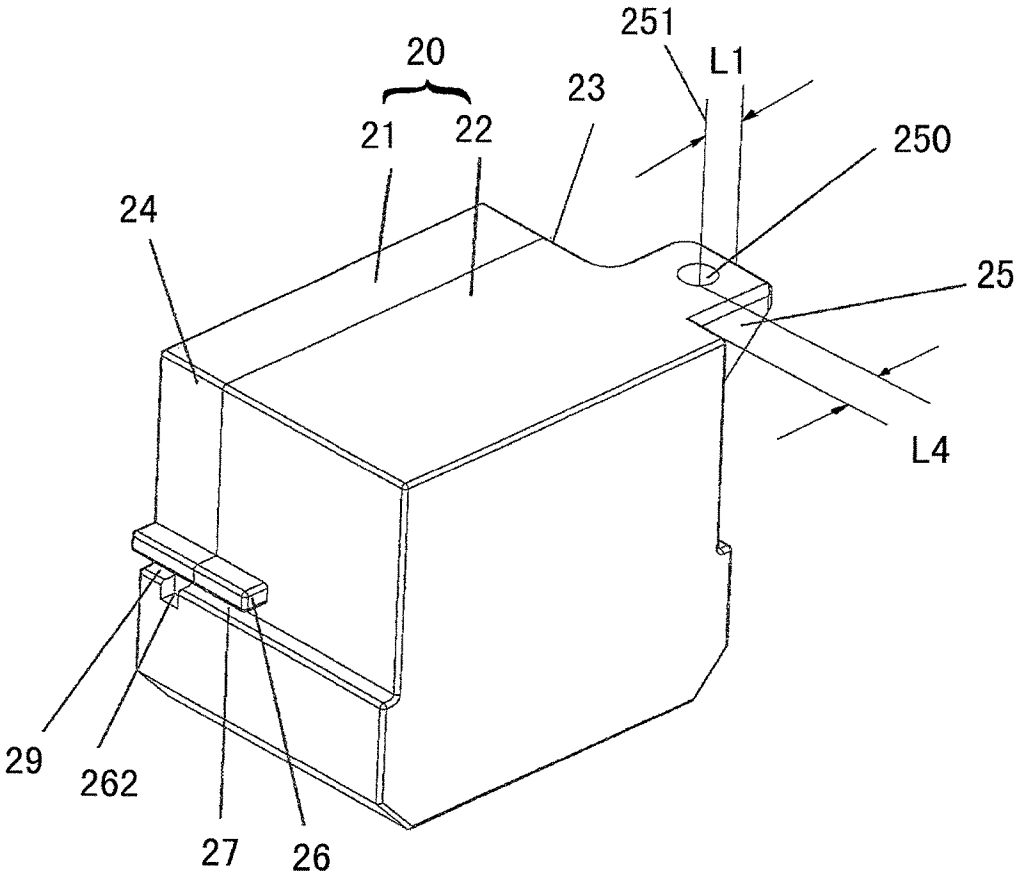
FIG. 5 is a schematic view showing a wiring box in a second embodiment of the invention.
Figure 6:
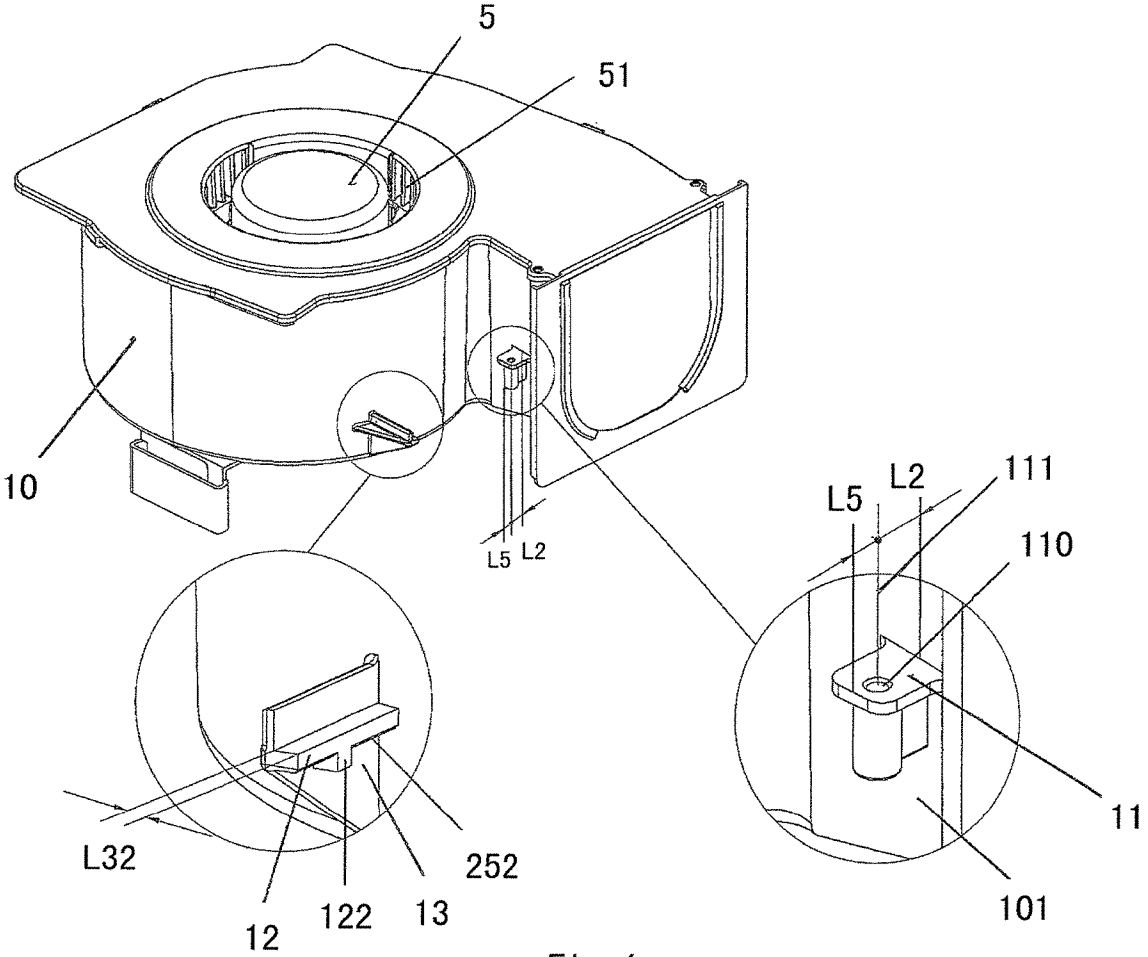
FIG. 6 is a schematic view showing a casing in the second embodiment of the invention.

FIG. 5 is a schematic view showing a wiring box in a second embodiment of the invention; FIG. 6 is a schematic view showing a casing in the second embodiment of the invention.

As shown in FIGS. 5 and 6, the difference between the first and the second embodiments lies in different positions at which the protuberance and the cutout are disposed.

Specifically, in the second embodiment, the first rib 12 is provided with a second protuberance 122 on a horizontal bottom surface 252 thereof in the vertical direction, a third rib 27 is provided with a second cutout 262 engaging with the second protuberance 122 on the first rib 12, and the positional relationship between the wiring box 20 and the casing 10 meets the following conditions:

$$L1<L2,$$

and $$L2-L1=L32,$$

wherein, L1 is a distance from a central line 251 of the hole 250 in the first boss 25 of the wiring box 20 to an outmost edge of the first end 23 of the wiring box 20, L2 is a distance from a central line 111 of the hole 110 in the second boss 11 of the casing 10 to a side wall 101 of the casing 10, and L32 is a width of the first rib 12 of the third boss 13 of the casing 10 extending inwards, that is, towards the second boss 11.

The positional relationship also meets the following conditions:

$$L4>L5,$$

and $$L4-L5=L32,$$

wherein, L4 is a distance from the central line 251 of the hole 250 in the first boss 25 of the wiring box 20 to the side wall of first end 23 of the wiring box 20, L5 is a distance from the central line 111 of the hole 110 in the second boss 11 of the casing 10 to the outmost edge of the first boss 11 of the casing 10 extending towards the third boss 13.

When the wiring box 20 is fixed onto the casing 10, the second fixing means 32 is firstly fixed, and then the first fixing means 31 is fixed. Specifically, firstly, the gap formed between the second rib 26 and the third rib 27 that are formed at the second end 24 of the wiring box 20 and protruded outwards, i.e., the first recess 29, is aligned with the first rib 12 formed on the third boss 13 of the casing 10. Then, push the wiring box 20 towards the fan blades 51 and the motor 5 of the casing 10. In such a manner, the first recess 29 in the wiring box 20 contacts the first rib 12 and moves, following the guidance of the first rib 12, in a direction toward the fan blades 51 and the motor 5 of the casing 10 due to the external force pushed on the wiring box 20.

Because the first rib 12 is provided with the second protuberance 122 on the horizontal bottom surface 252 thereof in the vertical direction, the second protuberance 122 may contact the third rib 27 so that the wiring box 20 cannot move towards the casing 10 anymore. In this situation, because L1<L2, L2−L1=L32, L4>L5, and L4−L5=L32, a user only needs to move the wiring box 20 towards the second boss 11 of the casing 10, then move the wiring box 20 towards the fan blades 51 and the motor 5 of the casing 10, and when the wiring box 20 is moved such that the second protuberance 122 is aligned with the second cutout 262, move the wiring box 20 towards the third boss 13 of the casing 10 such that the second protuberance 122 projecting from the horizontal bottom surface 252 of the first rib 12 in the vertical direction of the first rib 12 of the casing 10 is engaged into the second cutout 262 provided in the third rib 27 of the wiring box 20. In such a manner, movements of the second end 24 of the wiring box 20 in the fore-and-aft and up-and-down directions are restricted, and at this time, the hole 250 in the first boss 25 provided at the first end 23 of the wiring box 20 is overlapped with hole 110 in the second boss 11 extending from the casing 10. Finally, a screw is passed through the hole 250 in the first boss 25 and the hole 110 in the second bosses 11 from top to bottom, such that the wiring box 20 is fixed on the casing 10.

In such a manner, the movements of the first end 23 of the wiring box 20 in the up-and-down, fore-and-aft, and left-and-right directions are restricted by the screw, and at the same time, a movement of the second end 24 of the wiring box 20 in the left-and-right direction is restricted too.

With the above configuration, only one screw is needed to securely fix the wiring box 20 on the casing 10, and the wiring box 20 is protected from being detached by a user manually.

Figure 7:
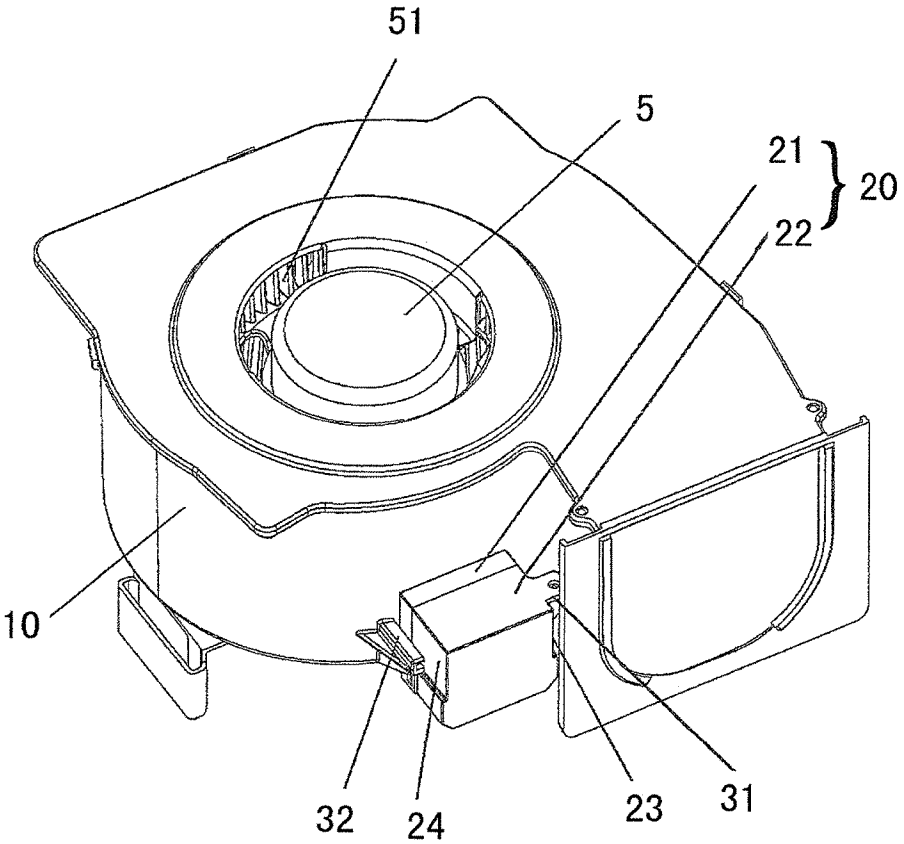
FIG. 7 is an overall schematic view showing a ventilating fan according to a third embodiment of the invention, in which the housing is removed.
Figure 8:
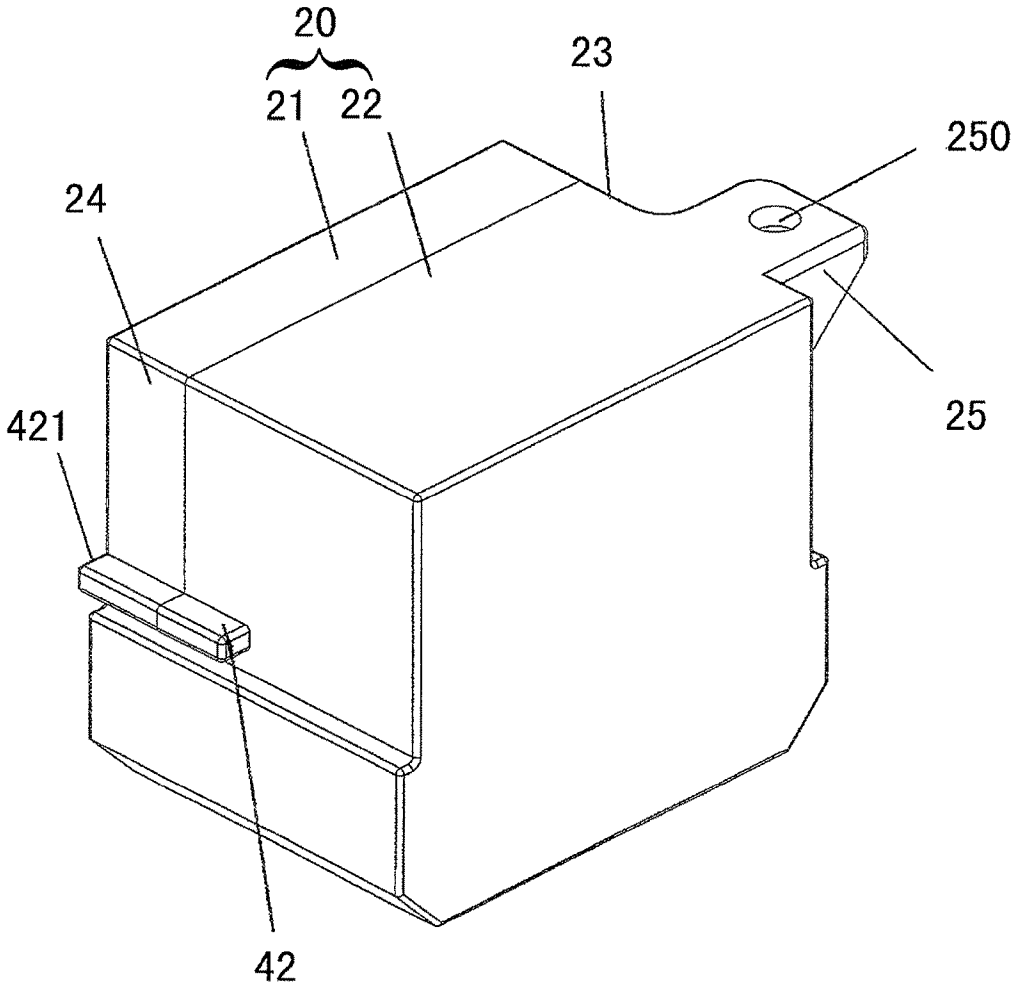
FIG. 8 is a schematic view showing a wiring box in the third embodiment of the invention.
Figure 9:
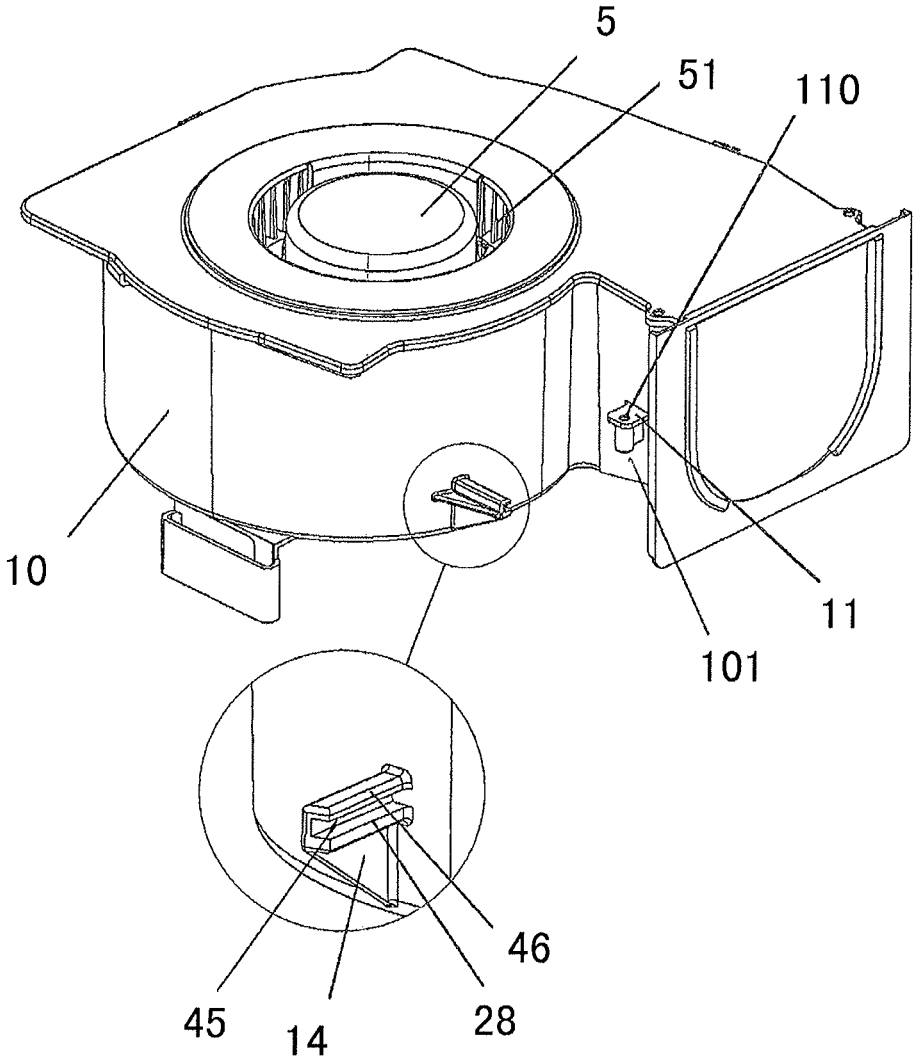
FIG. 9 is a schematic view showing a casing in the third embodiment of the invention.

FIG. 7 is an overall schematic view showing a ventilating fan of the third embodiment of the invention; FIG. 8 is a schematic view showing a wiring box in the third embodiment of the invention; FIG. 9 is a schematic view showing a casing in the third embodiment of the invention.

As shown in FIGS. 7, 8 and 9, the difference between the first and the third embodiments lies in different second fixing mean.

Specifically, the engaging fixing structure of the second fixing means 32 in the third embodiment comprises: a fourth rib 42 disposed on the second end 24 of the wiring box 20, and a second recess 45 formed on the casing 10 at a position corresponding to the fourth rib 42, the fourth rib 42 and the second recess 45 are engage with each other.

The fourth rib 42 is formed at the second end 24 of the wiring box 20 and protruded outwards, a fourth boss 14 is provided on the casing 10 at a position corresponding to the fourth rib 42 and protruded outwards, the second recess 45 is formed by a gap between a fifth rib 46 and a sixth rib 28, both of which are formed on the fourth boss 14 and protruded outwards, and the fourth rib 42 is movable within the second recess 45.

With the above configuration, when the wiring box 20 is fixed onto the casing 10, the second fixing means 32 is firstly fixed, and then the first fixing means 31 is fixed. Specifically, firstly, the fourth rib 42 formed at the second end 24 of the wiring box 20 and protruded outwards is aligned with and contacts the gap formed between the fifth rib 46 and the sixth rib 28 both formed on the fourth boss 14 of the casing 10, i.e., the fourth rib 42 is aligned with and contacts the second recess 45 formed in the fourth boss 14 of the casing 10. Then, push the wiring box 20 towards the fan blades 51 and the motor 5 of the casing 10, and the fourth rib 42 of the wiring box 20 contacts and moves along the second recess 45 in a direction toward the fan blades 51 and the motor 5 of the casing 10 due to the external force pushed on the wiring box 20, until the wiring box 20 is moved to a position where an end 421 of the fourth rib 42 contacts the casing 10. At this time, the hole 250 in the first boss 25 provided at the first end 23 of the wiring box 20 is overlapped with hole 110 in the second boss 11 extending from the casing 10. Finally, a screw is passed through the hole 250 in the first boss 25 and the hole 110 in the second bosses 11 from top to bottom, such that the wiring box 20 is fixed on the casing 10.

Moreover, the second recess 45 contacts the fourth rib 42, even if an external pushing force is applied, the force is distributed to the fourth boss 14, thus the external force applied on the fifth rib 46 and the sixth rib 28 is reduced, and the fifth rib 46 and the sixth rib 28 can be protected from being damaged.

Since the fourth rib 42 provided at the second end 24 of the wiring box 20 contacts and engages with the second recess 45 in the casing 10, a movement of the second end 24 of the wiring box 20 in the up-and-down direction is restricted. Moreover, after the wiring box 20 is pushed to a position where the end 421 of the fourth rib 42 contacts the casing 10, a screw is passed through the hole 250 in the first boss 25 and the hole 110 in the second bosses 11 from top to bottom, such that the wiring box 20 is fixed on the casing 10. As a result, a movement of the second end 24 of the wiring box 20 towards the fan blades 51 and the motor 5 of the casing 10 is also restricted. The movements of the first end 23 of the wiring box 20 secured by the screw in the up-and-down, fore-and-aft, and left-and-right directions are also restricted. At the same time, a movement of the second end 24 of the wiring box 20 in the left-and-right direction is restricted too.

With the above configuration, only one screw is needed to securely fix the wiring box 20 on the casing 10, and the wiring box 20 is protected from being detached by a user manually.

While the fifth rib 46 and the sixth rib 28 are protected from being damaged when the wiring box 20 is fixed on the casing 10, the number of components can be reduced, operating steps can be simplified, and labor time can be reduced. Moreover, since the second recess 45 is formed by the gap between the fifth rib 46 and the sixth rib 28 formed on the fourth boss 14 and protruded outwards, i.e., the fourth boss 14 is provided with the fifth rib 46 and the sixth rib 28, a reinforcing effect is provided, and thereby the fourth boss 14 is protect from being damaged.

Figure 10:
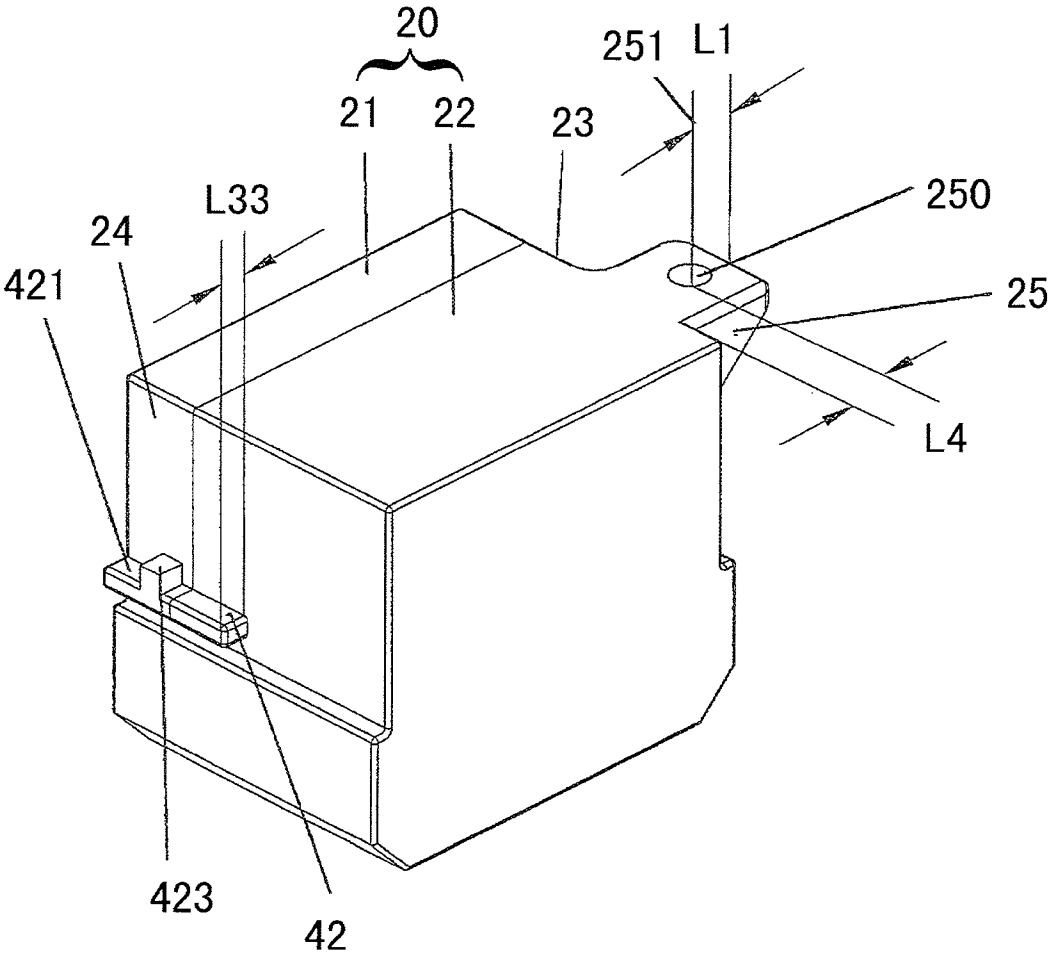
FIG. 10 is a schematic view showing a wiring box in a fourth embodiment of the invention.
Figure 11:
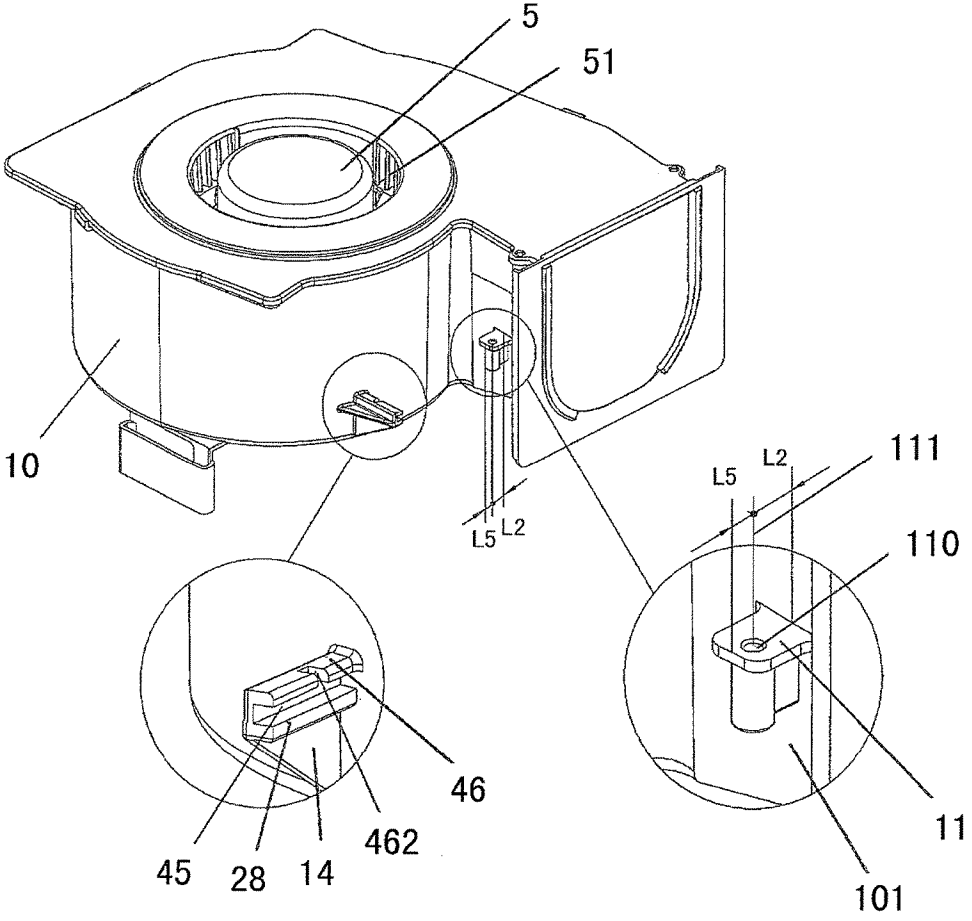
FIG. 11 is a schematic view showing a casing in the fourth embodiment of the invention.

FIG. 10 is a schematic view showing a wiring box in a fourth embodiment of the invention; FIG. 11 is a schematic view showing a casing in the fourth embodiment of the invention.

As shown in FIGS. 10 and 11, the difference between the fourth and the third embodiments lies in different second fixing means.

Specifically, the fourth rib 42 is provided with a third protuberance 423 on a horizontal top surface 421 thereof in the vertical direction, the fifth rib 46 is provided with a third cutout 462 engaging with the third protuberance 423 on the fourth rib 42, and the positional relationship between the wiring box 20 and the casing 10 meets the following conditions:

$$L1<L2,$$

and $$L2-L1=L33,$$

wherein, L1 is a distance from a central line 251 of the hole 250 in the first boss 25 of the wiring box 20 to an outmost edge of the first end 23 of the wiring box 20, L2 is a distance from a central line 111 of the hole 110 in the second boss 11 of the casing 10 to a side wall 101 of the casing 10, and L33 is a width the fourth rib 42 of wiring box 20 extending outwards, that is, towards the fourth boss 14.

The positional relationship also meets the following conditions:

$$L4>L5,$$

and $$L4-L5=L33,$$

wherein, L4 is a distance from the central line 251 of the hole 250 in the first boss 25 of the wiring box 20 to the side wall of first end 23 of the wiring box 20, L5 is a distance from the central line 111 of the hole 110 in the second boss 11 of the casing 10 to the outmost edge of the first boss 11 of the casing 10.

When the wiring box 20 is fixed onto the casing 10, the second fixing means 32 is firstly fixed, and then the first fixing means 31 is fixed. Specifically, firstly, the fourth rib 42 formed at the second end 24 of the wiring box 20 is aligned with the gap formed between the fifth rib 46 and the sixth rib 28 that are formed on the fourth boss 14 of the casing 10, i.e., the fourth rib 42 is aligned with the second recess 45 formed on the fourth boss 14. Then, push the wiring box 20 towards the fan blades 51 and the motor 5 of the casing 10. In such a manner, the fourth rib 42 on the wiring box 20 contacts the second recess 45 and moves along the second recess 45 in a direction toward the fan blades 51 and the motor 5 of the casing 10 due to the external force pushed on the wiring box 20.

Because the fourth rib 42 is provided with the third protuberance 423 on the horizontal top surface 421 thereof in the vertical direction, when the third protuberance 423 contacts the fifth rib 46, the wiring box 20 cannot move towards the casing 10 anymore. However, because L1<L2, L2−L1=L33, L4>L5, and L4−L5=L33, a user only needs to move the wiring box 20 towards the second boss 11 of the casing 10, then move the wiring box 20 towards the fan blades 51 and motor 5 of the casing 10, and when the wiring box is moved such that the third protuberance 423 is aligned with the third cutout 462, move the wiring box 20 towards the fourth boss 14 of the casing 10 such that the third protuberance 423 projecting from the horizontal top surface 421 of the fourth rib 42 in the vertical direction of the fourth rib 42 of the wiring box 20 is engaged into the third cutout 462 provided in the fifth rib 46 of the casing 10. In such a manner, movements of the second end 24 of the wiring box 20 in the fore-and-aft and up-and-down directions are restricted, and at this time, the hole 250 in the first boss 25 provided at the first end 23 of the wiring box 20 is overlapped with hole 110 in the second boss 11 extending from the casing 10. Finally, a screw is passed through the hole 250 in the first boss 25 and the hole 110 in the second bosses 11 from top to bottom, such that the wiring box 20 is fixed on the casing 10.

In such a manner, the movements of the first end 23 of the wiring box 20 in the up-and-down, fore-and-aft, and left-and-right directions are restricted by the screw, and at the same time, a movement of the second end 24 of the wiring box 20 in the left-and-right direction is restricted too.

With the above configuration, only one screw is needed to securely fix the wiring box 20 on the casing 10, and the wiring box 20 is protected from being detached by a user manually.

Figure 12:
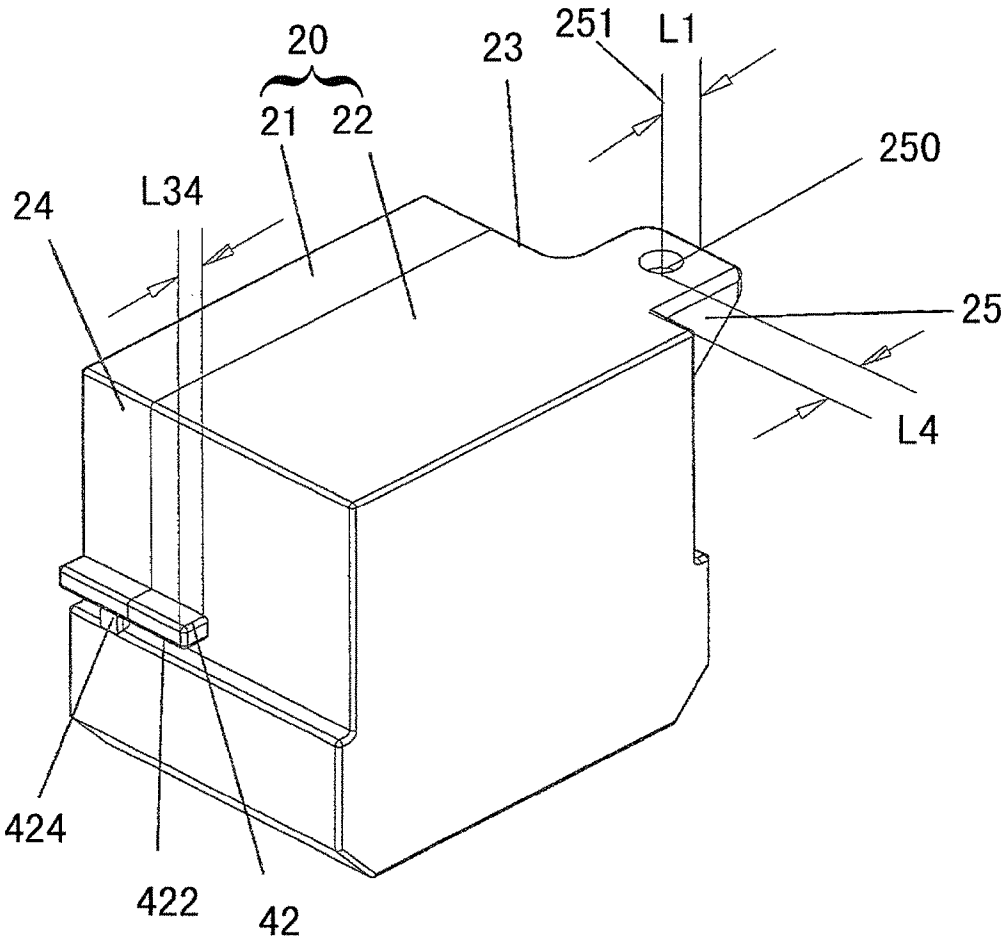
FIG. 12 is a schematic view showing a wiring box in a fifth embodiment of the invention.
Figure 13:
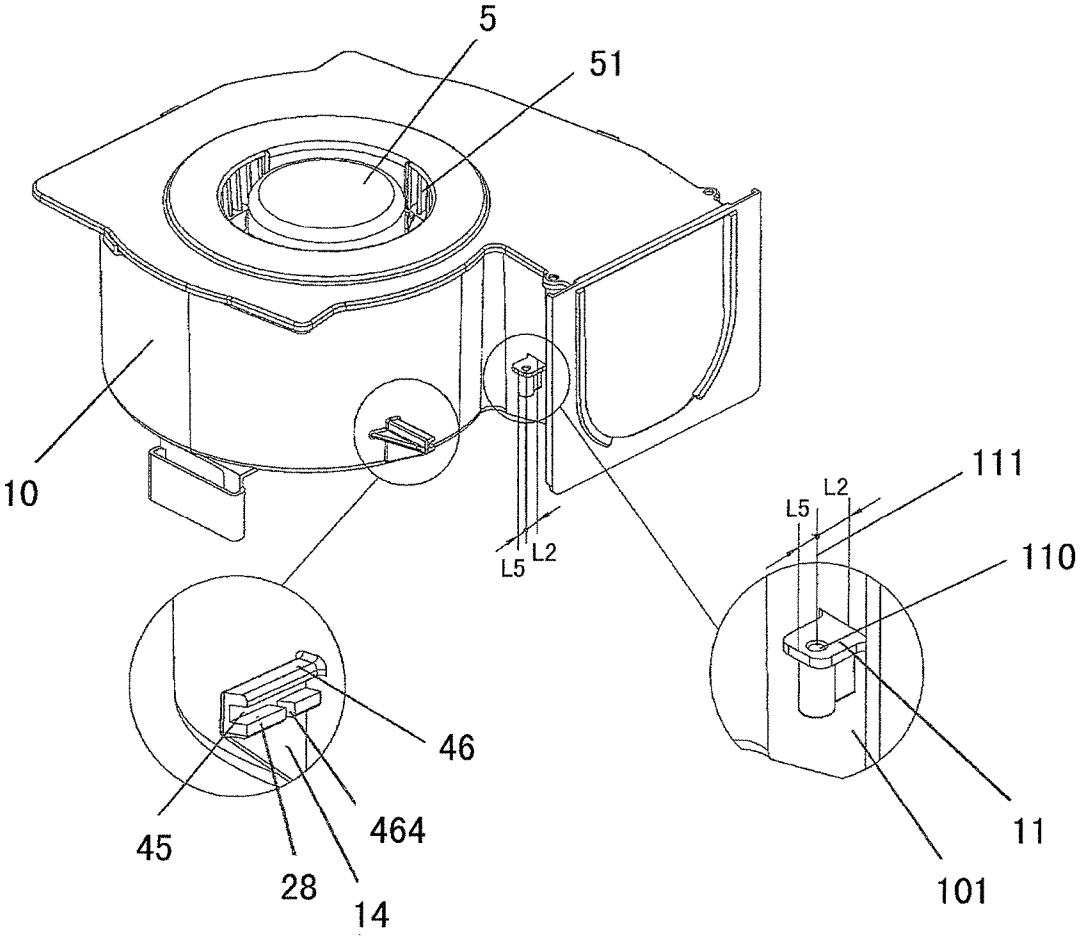
FIG. 13 is a schematic view showing a casing in the fifth embodiment of the invention.

FIG. 12 is a schematic view showing a wiring box in a fifth embodiment of the invention; FIG. 13 is a schematic view showing a casing in the fifth embodiment of the invention.

As shown in FIGS. 12 and 13, the difference between the fifth and the fourth embodiments lies in different positions at which the protuberance and the cutout are disposed.

Specifically, the fourth rib 42 is provided with a fourth protuberance 424 on a horizontal bottom surface 422 thereof in the vertical direction, the sixth rib 28 is provided with a fourth cutout 464 engaging with the fourth protuberance 424 on the fourth rib 12, and the positional relationship between the wiring box 20 and the casing 10 meets the following conditions:

$$L1<L2,$$

and $$L2-L1=L34,$$

wherein, L1 is a distance from a central line 251 of the hole 250 in the first boss 25 of the wiring box 20 to an outmost edge of the first end 23 of the wiring box 20, L2 is a distance from a central line 111 of the hole 110 in the second boss 11 of the casing 10 to a side wall 101 of the casing 10, and L34 is a width of the fourth rib 42 of the wiring box 20 extending outwards, that is, towards the fourth boss 14.

The positional relationship also meets the following conditions:

$$L4>L5,$$

and $$L4-L5=L34,$$

wherein, L4 is a distance from the central line 251 of the hole 250 in the first boss 25 of the wiring box 20 to the side wall of first end 23 of the wiring box 20, L5 is a distance from the central line 111 of the hole 110 in the second boss 11 of the casing 10 to the outmost edge of the second boss 11 of the casing 10.

When the wiring box 20 is fixed onto the casing 10, the second fixing means 32 is firstly fixed, and then the first fixing means 31 is fixed. Specifically, firstly, the fourth rib 42 formed at the second end 24 of the wiring box 20 and protruded outwards is aligned with the gap formed between the fifth rib 46 and the sixth rib 28 that are formed on the fourth boss 14 of the casing 10, i.e., the fourth rib 42 is aligned with the second recess 45 formed on the fourth boss 14 of the casing 10. Then, push the wiring box 20 towards the fan blades 51 and the motor 5 of the casing 10. In such a manner, the fourth rib 42 on the wiring box 20 contacts the second recess 45 and moves along the second recess 45 in a direction toward the fan blades 51 and the motor 5 of the casing 10 due to the external force pushed on the wiring box 20.

Because the fourth rib 42 is provided with the fourth protuberance 424 on the horizontal bottom surface 422 thereof in the vertical direction, when the fourth protuberance 424 contacts the six rib 48, the wiring box 20 cannot move towards the casing 10 anymore. However, because L1<L2, L2−L1=L34, L4>L5, and L4−L5=L34, a user only needs to move the wiring box 20 towards the second boss 11 of the casing 10, then move the wiring box 20 towards the fan blades 51 and motor 5 of the casing 10, and when the wiring box is moved such that the fourth protuberance 424 is aligned with the fourth cutout 464, move the wiring box 20 towards the fourth boss 14 of the casing 10 such that the fourth protuberance 424 projecting from the horizontal bottom surface 422 of the fourth rib 42 in the vertical direction of the fourth rib 42 of the wiring box 20 is engaged into the fourth cutout 464 provided in the sixth rib 28 of the casing 10. In such a manner, movements of the second end 24 of the wiring box 20 in the fore-and-aft and up-and-down directions are restricted, and at this time, the hole 250 in the first boss 25 provided at the first end 23 of the wiring box 20 is overlapped with hole 110 in the second boss 11 extending from the casing 10. Finally, a screw is passed through the hole 250 in the first boss 25 and the hole 110 in the second bosses 11 from top to bottom, such that the wiring box 20 is fixed on the casing 10. In such a manner, the movements of the first end 23 of the wiring box 20 in the up-and-down, fore-and-aft, and left-and-right directions are restricted by the screw, and at the same time, a movement of the second end 24 of the wiring box 20 in the left-and-right direction is restricted too.

With the above configuration, only one screw is needed to securely fix the wiring box 20 on the casing 10, and the wiring box 20 is protected from being detached by a user manually.

Figure 14:
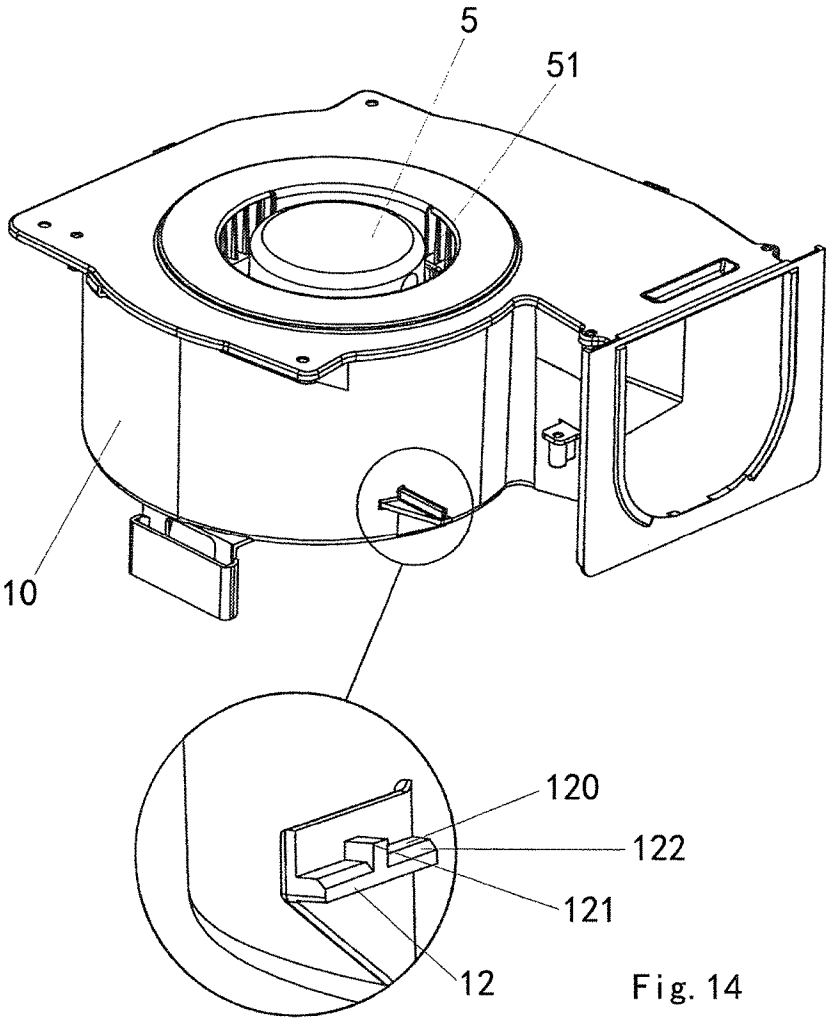
FIG. 14 is a schematic view showing a casing in a sixth embodiment of the invention.

FIG. 14 is a schematic view showing a casing in a sixth embodiment of the invention. As shown in FIG. 14, the difference between the sixth embodiment and the first embodiment lies in that, in the sixth embodiment, the first rib 12 is provided with an inclined portion 122 at a face thereof to be engaged by the first recess 29 (shown in FIG. 3).

Specifically, when the wiring box 20 is fixed onto the casing 10, the first recess 29 is aligned with and contacts the inclined portion 122 of the first rib 12, and the wiring box 20 is pushed towards the fan blades 51 and the motor 5 of the casing 10. Due to the external force pushed on the wiring box 20, the first recess 29 contacts and moves along the inclined portion 122 of the first rib 12 in a direction toward the fan blades 51 and the motor 5 of the casing 10, until a front end of the first recess 29 (shown in FIG. 3) of the wiring box 20 contacts the casing 10.

As above, with the inclined portion 122 provided at the first rib 12, the first recess 29 can engage with and move along the first rib 12 smoothly.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. A ventilating fan, comprising:

a housing having an opening at a bottom surface thereof, a casing disposed in the housing, fan blades and a motor disposed in the casing, and a wiring box fixed on the casing and composed of a box body and a cover, wherein the wiring box is fixed on the casing through a fixing structure, the fixing structure comprises a first fixing means and a second fixing means, and the first fixing means comprises a screw fixing structure, and the second fixing means comprises an engaging fixing structure including a rib which is disposed on the casing, and a groove which is disposed on the wiring box, the rib being fitted within the groove;

the engaging fixing structure of the second fixing means comprises the groove, which is a first groove, formed at a second end of the wiring box; and the rib, which is a first rib, is disposed on the casing at a position corresponding to the first groove, wherein the first rib and the first groove engage with each other.

2. The ventilating fan according to claim 1, wherein the screw fixing structure of the first fixing means comprises a first boss that protrudes outwards and is disposed at a first end of the wiring box, and a second boss that protrudes towards the wiring box and is provided on the casing at a position thereof corresponding to the first boss, and each of the first boss and the second boss are provided with a hole in a vertical direction.

3. The ventilating fan according to claim 2, wherein the first groove is formed by a gap between a second rib and a third rib, both of which are formed at the second end of the wiring box and protrude outwards, the casing is provided with a third boss that protrudes outwards, the first rib is disposed on a side of the third boss of the casing for engaging with the first groove, and the first rib is movable within the first groove.

4. The ventilating fan according to claim 3, wherein the first rib is provided with a first protuberance on a horizontal top surface thereof in the vertical direction, the second rib is provided with a first cutout engaging with the first protuberance on the first rib, and the positional relationship between the wiring box and the casing meets the following conditions:

$$L1<L2,$$

$$L2-L1=L31,$$

$$L4>L5, \text{ and}$$

$$L4-L5=L31,$$

wherein L1 is a distance from a central line of the hole in the first boss of the wiring box to an outmost edge of the first boss of the wiring box, L2 is a distance from a central line of the hole in the second boss of the casing to a side wall of the casing, L31 is a width of the first rib extended towards the second boss, L4 is a distance from the central line of the hole in the first boss of the wiring box to the side wall of first end of the wiring box, and L5 is a distance from the central line of the hole in the second boss of the casing to the outmost edge of the second boss of the casing opposite to the third boss of the casing.

5. The ventilating fan according to claim 3, wherein the first rib is provided with a second protuberance on a horizontal bottom surface thereof in the vertical direction, the third rib is provided with a second cutout engaging with the second protuberance on the first rib, and the positional relationship between the wiring box and the casing meets the following conditions:

$$L1<L2,$$

$$L2-L1=L32,$$

$$L4>L5, \text{ and}$$

$$L4-L5=L32,$$

wherein L1 is a distance from a central line of the hole in the first boss of the wiring box to an outmost edge of the first boss of the wiring box, L2 is a distance from a central line of the hole in the second boss of the casing to a side wall of the casing, L32 is a width of the first rib extended towards the second boss, L4 is a distance from the central line of the hole in the first boss of the wiring box to the side wall of first end of the wiring box, and L5 is a distance from the central line of the hole in the second boss of the casing to the outmost edge of the second boss of the casing opposite to the third boss of the casing.

6. The ventilating fan according to claim 2, wherein the first rib is provided with an inclined portion at a surface thereof engaging the first groove.

7. The ventilating fan according to claim 1, wherein the first rib is movable within the groove in a horizontal direction.

* * * * *